US005689090A

United States Patent [19]

Bleich et al.

[11] Patent Number: 5,689,090

[45] Date of Patent: Nov. 18, 1997

[54] FIRE RESISTANT NON-HALOGEN RISER CABLE

[75] Inventors: Larry Lynn Bleich, Omaha, Nebr.; Tommy Glenn Hardin, Lilburn, Ga.

[73] Assignee: Lucent Technologies Inc., Murray Hill, N.J.

[21] Appl. No.: 542,767

[22] Filed: Oct. 13, 1995

[51] Int. Cl.[6] ..... H01B 7/28

[52] U.S. Cl. ..... 174/121 A; 174/113 R

[58] Field of Search ..... 174/121 A, 107, 174/110 R, 110 PM, 113 R

[56] References Cited

U.S. PATENT DOCUMENTS

| | | | |
|---|---|---|---|
| 4,123,585 | 10/1978 | Sparkzak et al. | 428/379 |
| 4,284,842 | 8/1981 | Arroyo et al. | 174/107 |
| 4,319,940 | 3/1982 | Arroyo et al. | 156/56 |
| 4,412,094 | 10/1983 | Dougherty et al. | 174/110 F |
| 4,500,748 | 2/1985 | Klein | 174/121 A |
| 4,510,348 | 4/1985 | Arroyo et al. | 174/121 A |
| 4,595,793 | 6/1986 | Arroyo et al. | 174/121 A |
| 4,605,818 | 8/1986 | Arroyo et al. | 174/107 |
| 4,941,729 | 7/1990 | Hardin et al. | 350/96.23 |
| 4,952,428 | 8/1990 | Keogh | 428/461 X |
| 5,001,304 | 3/1991 | Hardin et al. | 174/107 |
| 5,024,506 | 6/1991 | Hardin et al. | 350/96.23 |
| 5,074,640 | 12/1991 | Hardin et al. | 350/96.23 |
| 5,158,999 | 10/1992 | Swales et al. | 524/100 X |
| 5,162,609 | 11/1992 | Adriaenssens et al. | 174/34 |
| 5,173,960 | 12/1992 | Dickinson | 385/100 X |
| 5,380,802 | 1/1995 | Termine et al. | 525/72 X |
| 5,422,614 | 6/1995 | Rampalli et al. | 333/237 X |
| 5,475,041 | 12/1995 | Weil et al. | 524/100 X |

*Primary Examiner*—Kristine L. Kincaid
*Assistant Examiner*—Chau Nguyen

[57] ABSTRACT

A communications cable that may be used in buildings in concealed areas such as riser shafts is constructed of non-halogen materials. The core includes insulated conductors that are enclosed with a plastic, polyolefin insulating material. These insulated conductors are twisted into pairs to form a multi-pair core. The core is surrounded and protected with a non-halogen, plastic jacket material. The cable has exceptional voice and data transmission properties due to the polyolefin insulation and is highly flame retardant. Compared with halogenated materials, the cable generates relatively little smoke, is less corrosive, and generates less toxic gases when burned.

9 Claims, 3 Drawing Sheets

*FIG. 2*

UL 1666 RISER FLAME TEST:

| SAMPLE REF. | TEST NO. | NO. OF LENGTHS | CABLE O.D. (in) | MAX FLAME HEIGHT (ft,in) | CABLE DAMAGE (ft,in) | | | COND. | MAX TEMP. |
|---|---|---|---|---|---|---|---|---|---|
| | | | | | MELT | CHAR | ASH | | |
| I | 1 | 23 | 0.510 | 11,0 | 12,3 | 12,0 | 10,6 | 11,0 | 503 |
| | 2 | | | 11,6 | 12,9 | 12,6 | 10,0 | 10,9 | 668 |
| II | 1 | 24 | 0.490 | 8,6 | 8,9 | 8,6 | 6,3 | 8,3 | 514 |
| | 2 | | | 6,6 | 7,3 | 6,3 | 5,6 | 6,3 | 460 |
| III | 1 | 24 | 0.500 | 7,6 | 7,6 | 6,6 | 5,0 | 6,0 | 540 |
| | 2 | | | 9,0 | 9,0 | 8,6 | 8,0 | 8,6 | 634 |

FIG. 3

| TOXICITY | |
|---|---|
| TEST NO. | AVG. TOXICITY INDEX |
| L14035 (JACKET) | 2.45 |
| L13845 (PELLETS) | 2.29 |

FIG. 4

| CORROSION | | |
|---|---|---|
| TEST NO. | pH | $\mu$-S |
| L14036 (JACKET) | 4.46<br>4.56<br>4.84<br>(AVG) 4.62 | 3.78<br>3.50<br>3.80<br>(AVG) 3.69 |
| L13844 (PELLETS) | 5.72<br>5.54<br>5.28<br>(AVG) 5.51 | 1.50<br>1.85<br>1.70<br>(AVG) 1.68 |

FIRE RESISTANT NON-HALOGEN RISER CABLE

FIELD OF INVENTION

This invention relates to non-halogen, flame resistant, multipair communications cable for use in premise wiring locations for voice or data transmission. In particular, it is suitable for use in local area networks for transmitting high frequency, digital signals. The cable is suitable for wiring between floors, in riser shafts and horizontal runs.

BACKGROUND OF THE INVENTION

The greatly increased use of computer and other types of digital electronic equipment in offices and manufacturing facilities for data, imaging, and video transmission, for example, has given rise to increased demand upon the signal transmitting cable used to connect these devices and associated peripheral equipment to each other. These demands must be met in order to insure substantially error free transmission at high bit rates. In addition, and of special importance, is the fact that such cables are generally used within a building, thus necessitating cables which are fire resistant and both smoke and flame retardant. These latter properties are of significant importance where the cable extends from floor to floor, in which case it is referred to as a riser cable.

Cables which consist of insulated copper conductors having a conventional jacket surrounding the core generally do not possess acceptable flame spread and smoke evolution properties. As the temperature in such a cable increases, charring of the jacket material commences, and, subsequently, the conductor insulation inside the jacket begins to decompose and char. Usually the jacket ruptures because of the expanding insulation char or the pressure of the generated gases, exposing the insulation to the flame whereby it pyrolizes and emits more flammable gases. In addition, when the jacket burns, it also generates gases. The gases generated during combustion of the cable, in addition to being highly flammable, are both toxic and corrosive, thus having a damaging effect on the surrounding structure and atmosphere beyond the immediate vicinity of the flames.

The Underwriters Laboratories perform stringent tests to verify that a cable will perform satisfactorily in its intended use, which tests include a burn test (UL-1666) in order to establish a CMR rating for communications cable used in riser and general purpose applications. The UL Burn Test 1666, known as a vertical tray test, is used by Underwriters Laboratories to determine whether a cable is acceptable as a riser cable. In that test, a sample of cable is extended upward from a first floor along a ladder arrangement having spaced rungs. A test flame producing approximately 527,500 Btu per hour, fueled by propane at a flow rate of approximately 211±11 standard cubic feet per hour, is applied to the cable for approximately thirty minutes. The maximum continuous damage height to the cable is then measured. If the damage height to the cable does not equal or exceed twelve feet, the cable is given a CMR rating approval for use as a riser cable.

There are, in the prior art, numerous cables which perform satisfactorily in a riser application, meeting both the electrical requirements and the flame spread requirement. In U.S. Pat. No. 4,284,842 of Arroyo et al., there is shown one such cable in which the multi-conductor core is enclosed in an inorganic sheath which is, in turn, enclosed in a metallic sleeve. The metallic sleeve is surrounded by dual layers of polyimide tape. The inorganic sheath resists heat transfer into the core, and the metallic sheath reflects radiant heat.

Such a cable effectively resists fire and produces low smoke emission, but requires three layers of jacketing material. Another example of a multilayer jacket is shown in U.S. Pat. No. 4,605,818 of Arroyo. In U.S. Pat. No. 5,074,640 of Hardin et al., there is disclosed a cable for use in plenums or riser shafts, in which the individual conductors are insulated by a non-halogenated plastic composition which includes a polyetherimide constituent and an additive system. The jacket includes a siloxane/polyimide copolymer constituent blended with a polyetherimide constituent and an additive system, including a flame retardant system. In U.S. Pat. No. 4,412,094 of Dougherty et al., a riser cable is disclosed wherein each of the conductors is surrounded by two layers of insulation. The inner layer is a polyolefin plastic material expanded to a predetermined percentage, and the outer layer comprises a relatively fire retardant material. The core is enclosed in a metallic jacket and a fire resistant material. Such a cable also meets the requirements for fire resistance and low smoke. However, the metallic jacket represents an added cost element in the production of the cable. In U.S. Pat. No. 5,162,609 of Adriaenssens et al., there is shown a fire resistant cable in which the metallic jacket member is eliminated. In that cable, each conductor of the several pairs of conductors has a metallic, i.e., copper center member surrounded by an insulating layer of solid, low density polyethylene which is, in turn, surrounded by a flame resistant polyethylene material. The core is surrounded by a jacket of flame retardant polyethylene. Such a structure meets the criteria for use in buildings and is, apparently, widely used.

As the use of computers has increased, and more particularly, as the interconnections of computers to each other, and to telephone lines, has mushroomed, a cable for interior use should, desirably, provide substantially error free transmission at very high frequencies. The satisfactory achievement of such transmission has not been fully realized because of a problem with most twisted pair and coaxial cables which, while not serious at low transmission frequencies, becomes acute at the high frequencies associated with transmission at high bit rates. This problem is identified and known as structural return loss (SRL), which is defined as signal attenuation resulting from periodic variations in impedance along the cable. SRL is affected by the structure of the cable and the various cable components, which cause signal reflections. Such signal reflections can cause transmitted or received signal loss, fluctuations with frequency of the received signals, distortion of transmitted or received pulses, increased noise at carrier frequencies and, to some extent, will place an upper signal frequency limit on twisted pair cables. Some of the structural defects that cause SRL are insulated conductors which fluctuate in diameter along their length, or where, for whatever reason, the surface of the wire is rough or uneven. Insulation roughness or irregularities, excessive eccentricity, as well as variations in insulation diameter, may likewise increase SRL. With dual insulated conductors, as shown in the aforementioned Dougherty et al., and Adriaenssens et al., patents, the problem of achieving uniformity of insulation is compounded because of the difficulty of forming a first layer that is substantially uniform and then forming a second, substantially uniform layer over the first. If the first layer is soft or compressible, the second layer can distort it, thereby increasing SRL to an undesirable level. If, in turn, the second layer is compressible, it can be distorted by the helical member used to bundle the cable pairs, or during the twisting process. Should the conductors of a twisted pair have varying spacing along their length, SRL can be undesirably increased. The presence of metallic shielding members or sleeves can also lead to undesirable increases in SRL.

For a Category 5 cable, which is the highest category, i.e., the category wherein the cable is capable of handling signals up to 100 MHz, the cable must meet the TIA/EIA 568A standard for premise wiring which requires low attenuation, tight impedance tolerances, low crosstalk, and low SRL. For a Category 5 cable, the SRL, in dB, should be 23dB from 1 to 20 MHz. For frequencies above 20 MHz, the allowable SRL is determined by $$SRL_f \geqq SRL_{20} - 10\log_{10}\left(\frac{f}{20}\right) \quad (1)$$

where $SRL_{20}$ is the SRL at 20 MHz and $f$ is the frequency in MHz. It should be understood that the measured SRL is given by dB below signal and hence, in actuality, is a negative figure.

The difference between the required or allowable SRL and the measured SRL is known as SRL margin. Therefore, the greater the SRL margin of a cable, the better the performance thereof. It can thus be appreciated that the necessity for flame retardance or fire resistance, especially in riser cables, and the desirable end of minimizing SRL, attenuation, and crosstalk resulting in unimpaired signal transmission, are not amenable to a simple solution. The achievement of a high level of flame retardance by the prior art methods as noted in the foregoing can, and most often does, lead to increased attenuation and SRL, as does the presence of metallic sleeves shielding or the like. While it is by no means impossible to achieve good electrical characteristics with some of the prior art flame retardant riser cables, the cost involved in assuring uniformity of the various conductors and double insulation layers, while not prohibitive, can be substantially more than is economically feasible.

Thus, there are three problems to be addressed in constructing a cable for uses discussed hereinbefore. The SRL, attenuation, and crosstalk should be as small as possible, and the flame retardation and smoke suppression, with the concomitant corrosion and toxic gas creation, should be minimized.

In U.S. patent application Ser. No. 08/334,657 of Bleich et al., filed Nov. 4, 1994, now U.S. Pat. No. 5,600,097 there is disclosed a riser cable in which SRL is substantially reduced from that of convention cables through the use of high density polyethylene (HDPE) as the insulating layer for each of the copper conductors. HDPE can be extruded uniformly to give a tough uniform insulation layer with a smooth outer surface, a relatively uniform thickness, and good adhesion to the conductor. Also, the single layer of insulation results in an insulated conductor that is slightly smaller in overall diameter with less eccentricity, than is typical of other types of insulations. As a consequence, attenuation and SRL are materially reduced. On the other hand, HDPE is highly flammable, which necessitates a jacket with superior flame retardant and smoke suppression characteristics.

The prior art is replete with materials that have been formulated for jackets with good flame retardation and smoke suppression. Among these materials are fluoropolymers which have been used both as conductor insulation and as jacket material with some degree of success. However, a fluoropolymer is a halogenated material. There are cables in the prior art, including that disclosed in the aforementioned patent application of Bleich, et al., which use halogenated materials for the cable jacket and still pass the UL standards for flame retardation and smoke suppression, but such materials can present other problems which are inherent in all halogenated materials. Such materials as fluoropolymers and polyvinylcholoride often exhibit undesired levels of corrosion, as explained heretofore, and emit, when burned or subjected to extremes of heat, gases of high level of toxicity, while polyvinylcholoride (PVC) emits hydrogen chloride during combustion. These gases are both corrosive and toxic.

For the most part the prior art has treated non-halogenated materials as unacceptable for use in riser cables because, generally, their flame retardant properties are not sufficient to meet even the minimum requirements for riser cables, or, for those non-halogenated materials that are sufficiently retardant and smoke suppressant, the material when used as a cable jacket is too stiff or inflexible for easy handling and routing. Non-halogenated materials, such as, for example, a polyphenylene oxide plastic material, have been used in countries other than the United States, primarily as one insulating material as opposed to a jacket material. However, such a material has not passed the industry standard tests for riser cables and smoke generation.

In U.S. Pat. Nos. 4,941,729 and 5,024,506, both of Hardin et al., there are disclosed cables which are suitable for use as plenum cables which utilize non-halogenated materials, both as insulation for the conductors and as material for the jacket. Such a cable successfully meets the industry standard requirements for flame retardation and smoke suppression in a plenum type cable. However, the processing of non-halogenated materials for insulation and jacketing requires more care, hence greater expense, than for conventional materials such as polyethylenes and polyvinylcholorides.

What is still sought is a riser cable which is relatively inexpensive and which is easy to process, which has excellent electrical characteristics including low SRL, which meets the UL test requirements for riser cables as to both flame retardation, which has excellent suppression, which is relatively non-corrosive, and which has low levels of corrosion and toxicity.

SUMMARY OF THE INVENTION

The cable of the present invention meets or exceeds the several desiderata set forth in the foregoing. The cable consists of insulated conductors twisted into pairs which are arranged in a honeycomb structure, forming the cable core, and a surrounding jacket of a polyolefin material. The principles of the invention are applicable to a range of twisted pairs, from one to one hundred or more. Each conductor of each pair comprises a central metallic conducting member encased in an insulating layer of a flame retardant material, preferably high density polyethylene (HDPE). Such a material can be uniformly extruded and resists distortion by the compressive forces typically encountered in the manufacturing and handling of the cable. These properties of the material minimize the attenuation and SRL of the cable when in use, inasmuch as fabrication and extrusion techniques of the HDPE material have reached a level where non-uniformities are minimized.

It has been found that a jacket formed of a polyolefin non-halogenated material has sufficiently high flame retardation and smoke suppression characteristics that it is not necessary that the HDPE insulation be compounded or treated to have other than its characteristics of flame retardation and smoke suppression. Thus, the core is surrounded by a jacket of a polyolefin non-halogenic material having a thickness sufficient to provide heat and flame protection for the insulated conductors, but also thin enough to maintain flexibility in the cable sufficient to afford ease of handling and routing.

Advantageously, the cable of this invention may be used as a riser cable which meets the flame spread and smoke generation (or suppression) requirements of the industry standards while exhibiting low corrosion and toxicity. Further, the cable has excellent electrical performance which exceeds TIA/EIA 568A criteria.

DESCRIPTION OF THE DRAWINGS

FIG. 2 is a table setting forth test results of the cable of FIG. 1 and two other prior art cables, for comparison purposes;

FIG. 3 is a table setting forth test results for toxicity of the jacket materials; and FIG. 4 is a table setting forth the test results for the acidity of the gases evolved during combustion of the material of the jacket of the cable of the invention.

DETAILED DESCRIPTION

Figure 1:
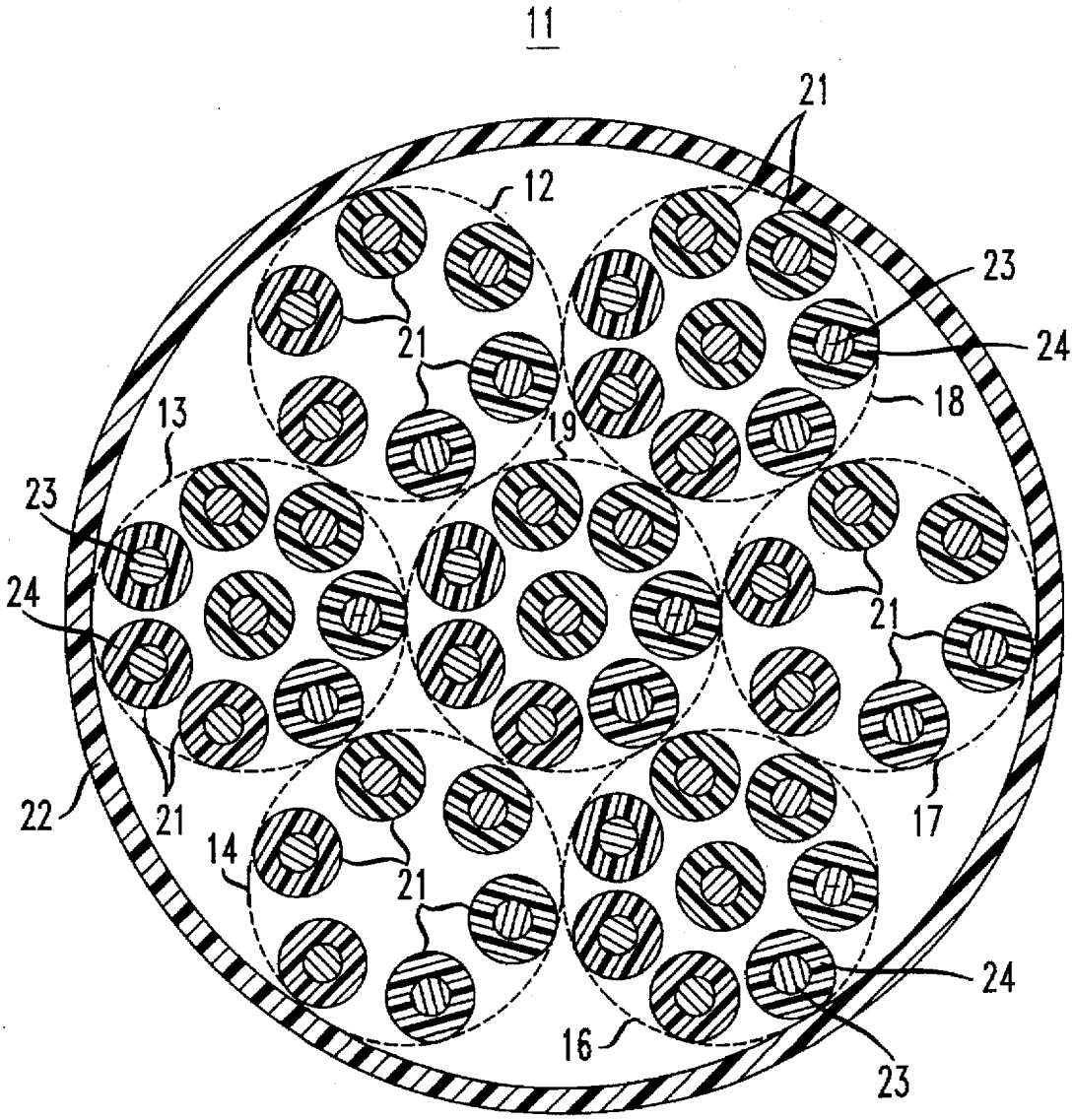
FIG. 1 is a cross-sectional elevational view of the cable of the invention.

In a preferred embodiment of the invention, cable 11 of FIG. 1 comprises seven groups 12, 13, 14, 16, 17, 18 and 19 of twisted conductor pairs, as delineated by the dashed lines, each pair of insulated conductors being identified by the reference numeral 21 inasmuch as all of the pairs are identical except for color coding and twist length. The conductors of each pair 21 are twisted together along their length and preferably held together as twisted by, for example, nylon in polyester twine. Within each of the groups 12, 13, 14, 16, 17, 18 and 19 the twist lengths of the several pairs differ in order to minimize cross-talk and inter-pair noise. Of the several groups, groups 13, 16, 18 and 19 have four twisted pairs and the groups 12, 14, and 17 have three twisted pairs for a total of twenty-five such pairs. It is to be understood that fewer or more twisted pairs may be used to make up the riser cable, however, a twenty-five pair cable is shown as a preferred embodiment. The dashed lines in FIG. 1 are not intended to represent any physical structure, but are used simply to delineate the several groups. In addition to the pairs being twisted, each group is also helically twisted with the twist lay of each group preferably differing from the layers in all of the other groups. Finally, all of the groups are twisted together and may be, although not necessarily, held by a suitable nylon binder yarn, for example, not shown. The core thus formed is enclosed within a jacket 22, and the entire assembly is referred to as a "honeycomb" structure, which minimizes cross-talk among the several conductors as well as inter-pair noise.

In accordance with the present invention, each conductor 23 of each twisted pair 21 is encased within an insulating sheath 24 of a polyolefin material such as high density polyethylene (HDPE). HDPE is a relatively tough dielectric material that can be uniformly extruded with a smooth outer surface, a relative uniform thickness, and adhesion to the conductor 23 that is within allowable limits. These are characteristics of polypropylene, a polyolefin material, also, and such material can be substituted for the HDPE without impairing electrical performance, as can polyethylene instead of HDPE. The latter is preferred, however, over other versions of polyethylene. Also, the single layer 24 of insulation on the conductor 23 results in an insulated conductor that is slightly smaller in overall diameter, and has less eccentricity, than the dual layers of insulation in the prior art, thereby enabling somewhat smaller cables of equal capacity. With such an insulating material having the characteristics set forth in the foregoing, and with the twisting of the several pairs, not only is crosstalk and inter-pair noise minimized, but so is structural return loss (SRL).

Where considerations of flame retardation are not a factor, the manufacturing techniques can be optimized to produce the greatest possible uniformity in the extruded insulation layer 24. HDPE is, however, a very flammable material and the practice in the prior art has been to use a treated insulation material or an insulating material that is normally fire resistant, or, as pointed out in the foregoing, a composite insulation consisting of a minimum of two layers, at least one of which is fire retardant. In practice, with such insulation arrangements, there has been a consistent failure because of the structural return loss which results from such arrangements being too high, making the cable unsuitable for use in its intended applications. Such failures often exceed ten percent (10%) of cable production, which is unacceptable from a cost standpoint. In order that the cable of the invention, as depicted in FIG. 1 be suitable for use in a riser cable, it is necessary that the outer jacket 22 be highly fire retardant. Equally as important is that the corrosion and toxic gases effects from the burning or severely overheated cable be minimized.

The effects of smoke, corrosion and toxic smoldering gases can be, to a large extent by use of a polyolefin based, non-halogen material that has been treated or otherwise manufactured in a manner to make it fire retardant, such as, for example, a material of a base resin of acetic acid ethenyl ester, a polymer with ethene, having magnesium hydroxide as a flame retardant and zinc borate as a smoke suppressant. Such a material is commercially available as Union Carbide DFDA-1980, which exhibits, in tests, good fire retardation and low smoke generation characteristics as well as a desirable flexibility. In the past, the cable industry in the United States, has generally avoided the use of non-halogenated materials for use in plenum and riser cables. Such materials, although possessing many desired properties such as low corrosion and toxic gas generation, seemingly were too inflexible to be used in a riser cable, whereas those non-halogenated materials which had the desired amount of flexibility, did not meet the higher United States standards for riser cables.

TEST RESULTS

In the testing and evaluation of the cable of the invention as depicted in FIG. 1, and for comparison purposes, three different twenty-five pair cables were tested, all of which used high density polyethylene (HDPE) insulation for the conductors, but each of which had a different jacket material, as follows:

1. 25 pair Type CMR cable employing solid HDPE insulation and overall PVC jacket.

2. Same as No. 1 except employs differently compounded PVC jacket compound.

3. Same as No. 1 except employs FRPE jacket Union Carbine 1980.

The following tests were conducted in accordance with Underwriters Laboratories Standard for Communications Cables, UL 444, and the results obtained complied with the requirements.

| | Cable I | Cable II | Cable III |
|---|---|---|---|
| DETAILED EXAMINATION: | | | |
| Number of conductors | 50 | 50 | 50 |
| Conductor diameter, mils | 19.9 | 19.8 | 19.9 |
| Lay of conductors, inches | 0.4 | 0.4 | 0.4 |
| Average Insulation thickness, mils | 8 | 9 | 8 |
| Minimum insulation thickness, mils | 7 | 9 | 7 |
| Average jacket thickness, mils | 29 | 28 | 30 |
| Minimum jacket thickness, mils | 26 | 24 | 28 |
| PHYSICAL PROPERTIES OF JACKET: Unaged | | | |
| Average tensile strength, lbf/in$^2$ | 2830 | 3485 | 1510 |
| Average elongated, percent | 260 | 258 | 180 |

As stated above, cables I and II have overall PVC jackets whereas cable III, the cable of the invention, has a polyolefin based non-halogen jacket. Consequently, only cable III meets the desiderata of low flame spread, low smoke, low corrosion, and low toxicity while, through the use of the material indicated, being sufficiently flexible for use as a riser cable. In FIG. 2, there are shown, in tabular form, the results of the UL 1666 riser flame tests for the three cables. It can be seen in FIG. 2 that both cables II and III were superior to cable I, being approximately equal to each other in flame retardation, as evidenced by the results for melt, char, and ash formation. Thus, for flame retardation, these two cables are capable of functioning as riser cables. Smoke tests on a cable using the jacket of cable III were performed using a standard IEC1034-2 procedure. The minimum measured light transmittance (a measure of the generated smoke) was 95.9%, and indication of extremely low smoke generation. Cable III, however, has a non-halogen jacket, and thus is superior to cable II in that it intrinsically has lower corrosion and toxicity. The results of tests performed on the material of the jacket 22 of the cable of the invention (cable III) are shown in FIG. 4 for acidity, which is a measure of corrosive effect, and FIG. 3 for toxicity.

FIG. 3 depicts, in tabular form, the results of toxicity tests on non-halogen jacket material of the invention. The tests were performed in accordance with the Navel Engineering Standard Test No. NES-713 for measuring the toxicity of the generated gases during burning, and three test runs on the jacket and three test runs on the pellets of material used to form the jacket were performed. The average toxicity in units per 100 gms is given in FIG. 3 for both forms of material, and it can be seen that the values are considerably below the allowable toxicity maximum of 5 units per 100 gms.

FIG. 4 depicts, in tabular form, the results of acidity (a measure of corrosivity) tests on gases evolved during combustion of the non-halogen material of the jacket of the invention. The tests were performed in accordance with the International Electrical Technical Committee test IEC 765-2:1991 on a jacket of the non-halogen material used in the present invention and on pellets of the material, with three tests being performed on each. Desirably, for low corrosivity, the material should exhibit a pH (a measure of acidity) of above 4.3, and a conductivity in micro-simens of less than 10. The test results shown in FIG. 4 clearly demonstrate that the jacket of the present invention meets or exceeds the requirements for low corrosivity.

Surprisingly, the cable of this invention (cable III), which includes non-halogenated jacketing material not only meets acceptable industry standards for flame spread and smoke generation, but also has relatively low corrosivity and an acceptable level of toxicity. This result is surprising and unexpected because it has long been thought that non-halogenated materials which would have acceptable levels of flame spread and smoke generation would be excessively rigid and those which had suitable flexibility would not provide suitable flame spread and smoke generation properties to satisfy industry standards. The conductor insulation of high density polyethylene and the non-halogenated jacketing material cooperate to provide a cable having high electrical performance with low structural return loss and which delays transfer of heat to the insulated conductor members. Because conductive heat transfer, which decomposes conductor insulation, is delayed, smoke emission and further flame spread are controlled.

The principles of the invention have been demonstrated and discussed as embodied in a preferred embodiment thereof. It is to be understood that these same principles are applicable to other types of communication arrangements such as, for example, optical fibers.

In conclusion, it should be noted that it will be obvious to those skilled in the art that many variations and modifications may be made to the preferred embodiment without substantial departure from the principles of the present invention. All such variations and modifications are intended to be included herein as being within the scope of the present invention as set forth in the claims. Further, in the claims, the corresponding structures, materials, acts, and equivalents thereof and of all means or step plus function elements are intended to include any structure, material, or acts for performing the functions in combination with other claimed elements as specifically set forth.

We claim:

1. A communication cable comprising:

a core having at least one pair of signal transmitting members of a communication transmission medium, each of said members having disposed thereabout a single, relatively uniform insulation layer of a non-fire retardant polyolefin material; and an outer jacket surrounding said core, said outer jacket comprising a fire retardant non-halogenated polyolefin material that comprises a base resin of an acetic acid ethenyl ester polymer with ethene having flame retardant and smoke suppressant materials therein.

2. A communication cable as claimed in claim 1 wherein said insulation layer comprises the polyolefin material polyethylene.

3. A communication cable as claimed in claim 2 wherein the polyethylene material is high density polyethylene.

4. A communication cable as claimed in claim 1 wherein said insulation layer comprises the polyolefin material polypropylene.

5. A communication cable for use within a building comprising:

a core comprising a plurality of insulated conductors arranged in twisted groups of twisted pairs of conductors to form a honeycomb structure;

each of said conductors having a single, relatively uniform insulation layer of a non-fire retardant polyolefin material; and an outer jacket surrounding and enclosing said honeycomb structured core, said outer jacket comprising a base resin of an acetic acid ethenyl ester, polymer with ethene having flame retardant and smoke suppressant materials therein and having low corrosivity and toxicity.

6. A communication cable as claimed in claim 5 wherein said non-halogenated polyolefin material of said jacket has a measured pH greater than 4.3 thereby indicating low corrosivity.

7. A communication cable as claimed in claim 5 wherein said non-halogenated polyolefin material of said jacket has a measured toxicity of less than five units per one-hundred grams, thereby indicating a low toxicity.

8. A communication cable as claimed in claim 5 wherein the polyolefin material of said insulation layer is high density polyethylene.

9. A communication cable as claimed in claim 5 wherein the polyolefin material of said insulation layer is polypropylene.

* * * * *